US006712057B2

(12) United States Patent
Andrews

(10) Patent No.: US 6,712,057 B2
(45) Date of Patent: Mar. 30, 2004

(54) ARCHERY BOW ASSEMBLY

(76) Inventor: Albert A. Andrews, 423 Old Tasso Place Rd., Cleveland, TN (US) 37312

( * ) Notice: Subject to any disclaimer, the term of this patent is extended or adjusted under 35 U.S.C. 154(b) by 0 days.

(21) Appl. No.: 10/256,623

(22) Filed: Sep. 27, 2002

(65) Prior Publication Data

US 2003/0084893 A1 May 8, 2003

Related U.S. Application Data

(60) Provisional application No. 60/325,376, filed on Sep. 27, 2001.

(51) Int. Cl.[7] ..... F41B 5/00
(52) U.S. Cl. ..... 124/23.1
(58) Field of Search ..... 124/23.1, 25.6, 124/86, 88

(56) References Cited

U.S. PATENT DOCUMENTS 3,628,519 A * 12/1971 Hofmeister
3,957,027 A * 5/1976 Drake
4,955,354 A * 9/1990 Bozek ..... 124/23.1
5,464,001 A * 11/1995 Peck
5,706,794 A * 1/1998 Neal
5,816,233 A 10/1998 Andrews
5,881,704 A 3/1999 Andrews
6,019,097 A * 2/2000 Cox et al. ..... 124/23.1
6,055,974 A * 5/2000 Dieziger
6,082,346 A 7/2000 Andrews et al.
6,250,293 B1 6/2001 Andrews
6,253,752 B1 * 7/2001 Cox et al. ..... 124/23.1
6,360,734 B1 3/2002 Andrews
6,367,464 B1 * 4/2002 Bronnert ..... 124/23.1

* cited by examiner

*Primary Examiner*—John A. Ricci
(74) *Attorney, Agent, or Firm*—Clark Hill PLC

(57) ABSTRACT

An archery bow comprising a riser extending between opposing first and second ends. A limb is coupled to each end of the riser. Each limb has a first end for connecting to the riser and a second distal end. A pocket axle pivotally connects the first ends of each limb to one end of the riser. A strut assembly is operatively coupled between each of the limbs and the riser adjacent the pocket axle for selectively pivoting the limbs relative to the riser thereby allowing manual assembly and tuning of the bow by varying the distance between the distal ends of the limbs.

16 Claims, 5 Drawing Sheets

24
30
14
10
22
44
38
42
18
12
36
20
42
40
34
44
26
16
32
28

ARCHERY BOW ASSEMBLY

This application claims the benefit of provisional application No. 60/325,376 filed Sep. 27, 2001.

BACKGROUND OF THE INVENTION

1. Field of Invention

The present invention relates to archery bow assemblies, and more particularly, to a strut assembly for mounting the limbs of the bow to the riser.

2. Description of the Related Art

Archery bows typically include a riser defining a handle for holding the bow and a pair of limbs extending from opposite ends of the riser to distal ends. A wheel or cam is commonly rotatably attached to the distal end of each limb and a string and harness system is wound between the wheels or cams of the limbs. The limbs are often flexed and the string and harness system is loaded under high tension to define the draw weight or force required to pull the string of the bow to its full draw position.

It is often desirable to change the string of the bow due to excessive wear or to change the draw weight of the bow. To change the string or other component of the bow typically requires the use of a bow press to flex the limbs of the bow and release the tension on the string and harness allowing removal from the wheels or cams. The bow press may then be used to release the flex on the limbs for complete disassembly of the bow.

The draw weight of the bow may be changed by attaching a different length string between the wheels or cams or by change the angle or orientation of the limbs relative to the bow. It is common to connect the limbs of the bow to the riser with a bolt or connector which extends through the limb and is threaded into the riser. The connector may be loosened to change the orientation of the limbs on the riser and slightly adjust the draw weight of the bow. However, significant shearing forces are exerted on the connector as the orientation of the limbs relative to the riser is changed. Additionally, the connector does not allow the bow to be assembled or disassembled without the use of a bow press.

Therefore, it remains desirable to provide a bow which may be manually assembled and disassembled without the need of a bow press and also an assembly which provide for full adjustment of the draw weight and tuning of the bow.

SUMMARY OF THE INVENTION

According to one aspect of the invention there is provided an archery bow comprising a riser extending between opposing first and second ends. A limb is coupled to each end of the riser. Each limb has a first end for connecting to the riser and a second distal end. An axle pivotally connects at least one of the limbs to one end of the riser. A strut assembly is operatively coupled between at least one of the limbs and the riser adjacent the axle for selectively pivoting the limb relative to the riser thereby allowing manual assembly and tuning of the bow by varying the distance between the distal ends of the limbs.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
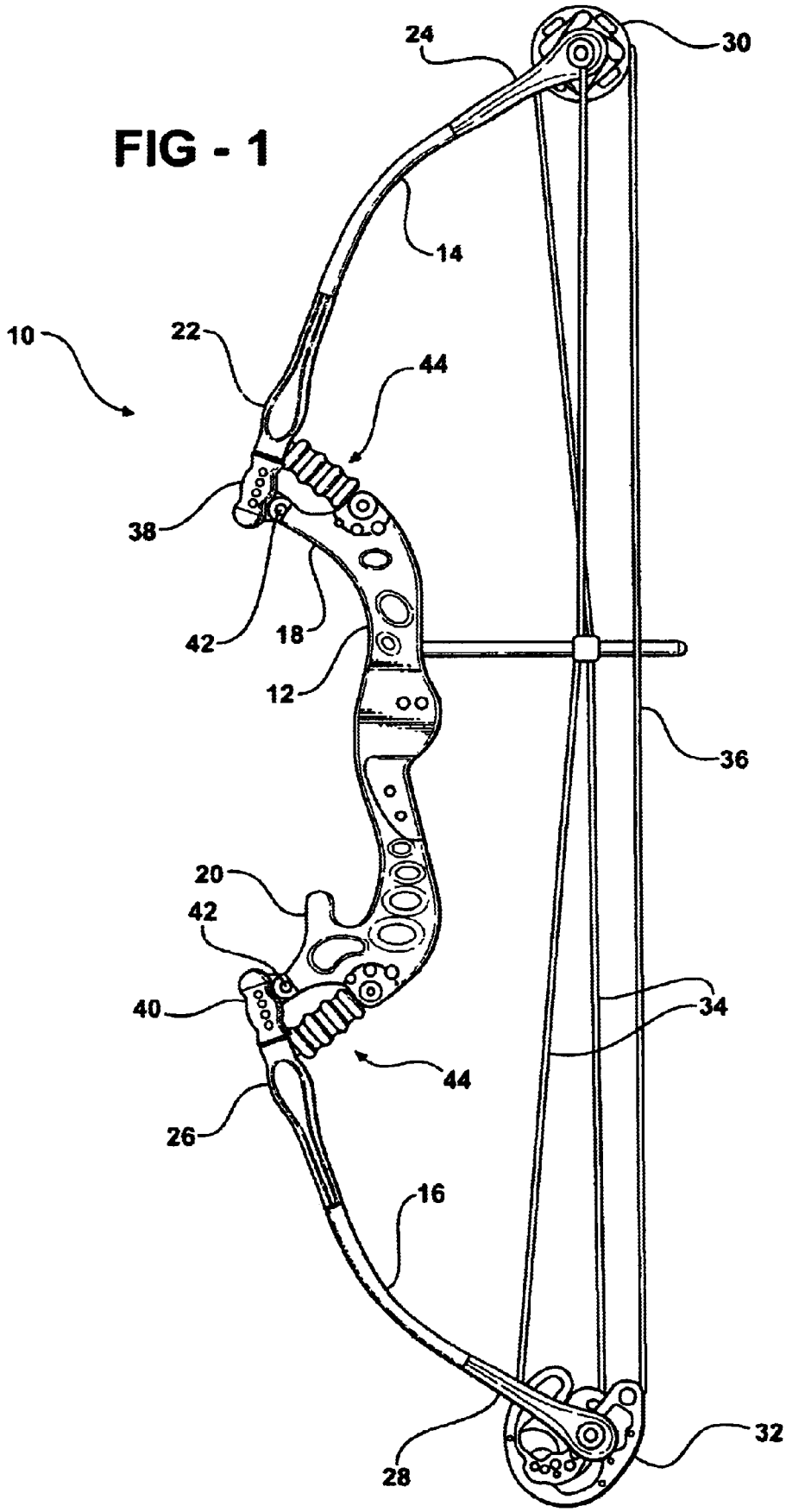
FIG. 1 is a side view of an archery bow assembly according to one aspect of the invention.

Referring to the drawings, FIG. 1 illustrates a compound archery bow 10 having a riser 12 with a pair of limbs 14, 16 extending from opposing ends 18, 20 of the riser 12. The limb 14 has a first end 22 connected to the end 18 of the riser 12 and a second distal end 24. Similarly, the limb 16 has a first end 26 connected to the opposite end 20 of the riser 12 and a second distal end 28. A wheel or cam 30, 32 is rotatably attached to each distal end 24, 28 of the limbs 14, 16. Additionally, a harness or cable system 34 and bow string 36 are wound around and between each wheel or cam 30, 32 and pulled in tension by the limbs 14, 16.

The bow 10 further includes a pair of limb pockets 38, 40 for pivotally attaching the respective limbs 14, 16 to the opposing ends 18, 20 of the riser 12. A pocket axle 42 pivotally couples each of the respective limbs pockets 38, 40 to the opposing ends 18, 20. Finally, a strut assembly 44 adjustably couples each of the limb pockets 38, 40 to the opposing ends 18, 20 of the riser. The strut assembly 44 allows for assembly and disassembly of the limbs 14, 16 and limb pockets 38, 40 to the riser 12 as well as the harness system 34 and string 36 between the wheels or cams 30, 32. Additionally, the strut assembly 44 further allows for selective micro-tuning and adjustment of the bow 10, such as for example, the adjustment of the bow's draw weight and/or axle to axle length between the wheels or cams 30, 32.

Figure 2:
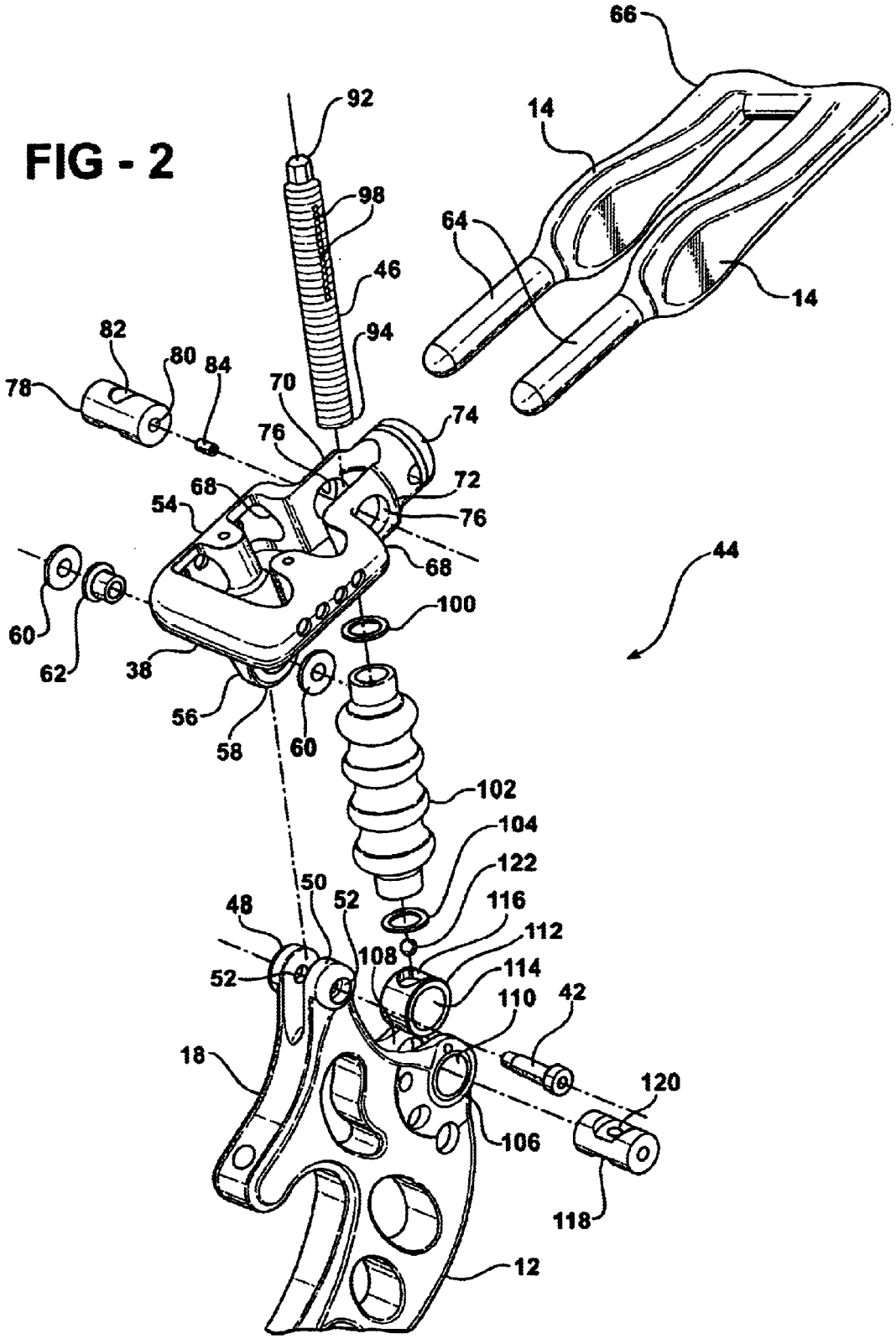
FIG. 2 is a fragmentary exploded view of the archery bow assembly and strut assembly for attaching the limbs to the riser.
Figure 3:
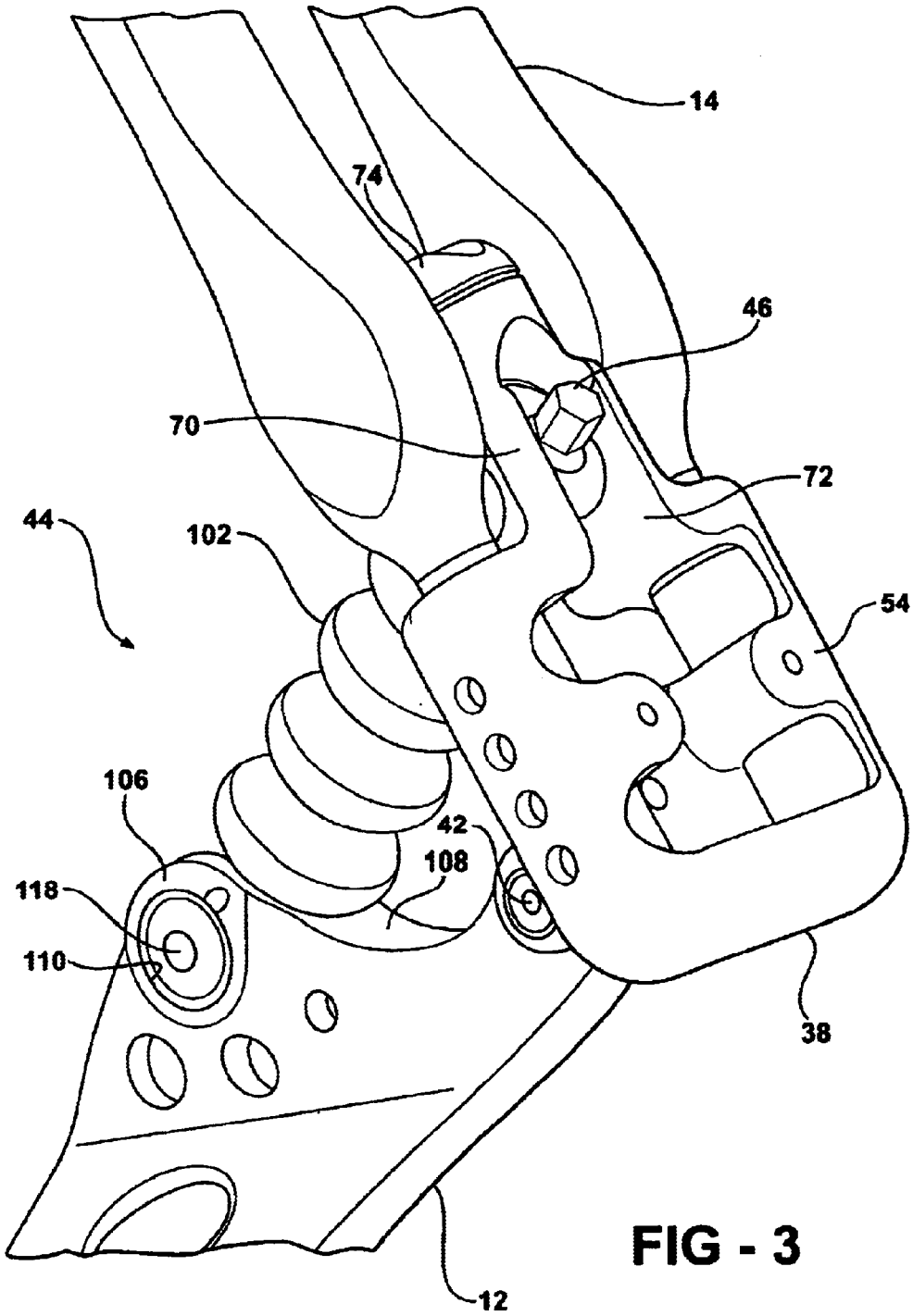
FIG. 3 is an enlarged perspective view of the strut assembly connected between the limb and the riser.
Figure 4:
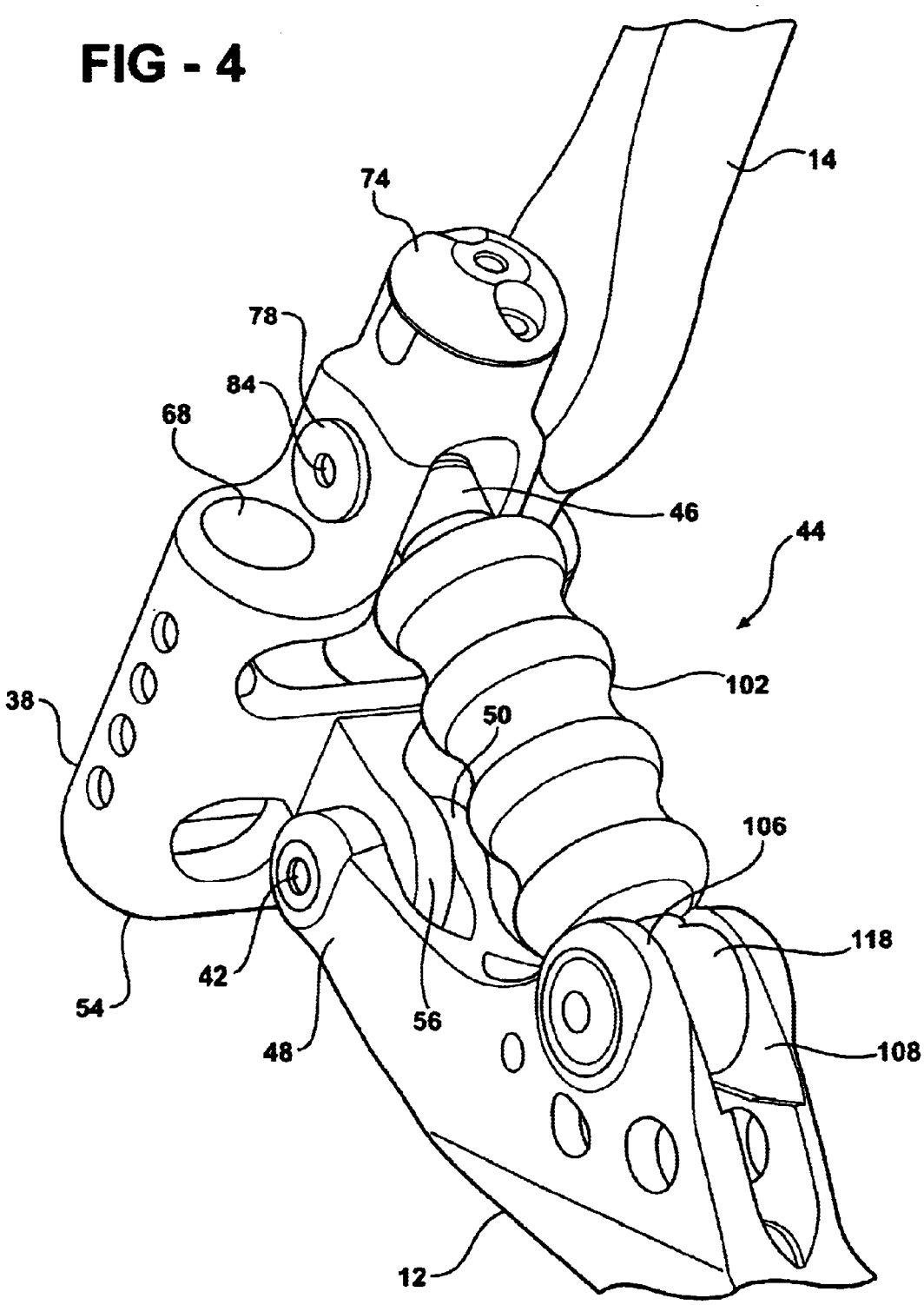
FIG. 4 is another enlarged perspective view of the strut assembly connected between the limb and the riser with a portion of the limb removed.

More specifically, referring to FIGS. 2–5, the strut assembly 44 is shown in more detail. Only one strut assembly 44 between the limb 14 and riser 12 will be described in detail, however, it should be appreciated that the strut assembly 44 between the opposite limb 16 and riser 12 includes the same elements and function. The strut assembly 44 includes an adjustable threaded strut power screw 46 coupled to and between the limb pocket 38 and the end 18 of the riser 12. Referring more particularly to FIG. 2, the end 18 of the riser 12 includes an extended pair of spaced apart fingers 48, 50 each having a bore 52 therethrough for receiving the pocket axle 42 and pivotally securing the limb pocket 38 to the riser 12. The limb pocket 38 includes a base 54 having a pivot post 56 extending therefrom with a through bore 58. The pivot post 56 is seated between the fingers 48, 50 and the bores 52, 58 aligned axially to receive the pocket axle 42 therethrough. A spacer 60 is received on each side of the pivot post 56 around the axle 42 and an end cap or bushing 62 is secured to the distal end of the pocket axle 42 to pivotally secure the limb pocket 38 to the riser 12 while allowing pivotal movement of the limb 14 and limb pocket 38 about the pocket axle 42 and end 18 of the riser 12.

Each limb 14, 16 may be a single unitary member, may be two spaced apart members or may be a split limb, as shown in FIG. 2, with a pair of substantially separate and parallel spaced apart limb posts 64 connected to a main member 66. The base 54 of the limb pocket 38 includes spaced apart tunnels 68 for receiving and mounting the limb posts 64 to the limb pocket 38 along the longitudinal length thereof. The limb posts 64 may be secured to the limb pocket 38 by any suitable means.

The limb pocket 38 further includes a pair of spaced apart support posts 70, 72 extending longitudinally from the base 54 and attached by an end cap 74. Each support post 70, 72 includes a bore 76 therethrough, the axis of which is parallel to the pocket axle 42. A cylindrical strut pivoting power screw nut 78 is seated in each bore 76 between the spaced apart and parallel support posts 70, 72. The screw nut 78 includes a longitudinal bore 80 extending therethrough and a transverse bore 82 extending perpendicular to the bore 80 for receiving the strut power screw 46. Each of the bores 80, 82 are threaded and the screw nut 78 is freely rotatably seated in the bores 76 of the support posts 70, 72. The power screw 46 is threaded through the bore 82 toward the riser 12 and retained in the limb pocket 38 by the screw nut 78.

Figure 5:
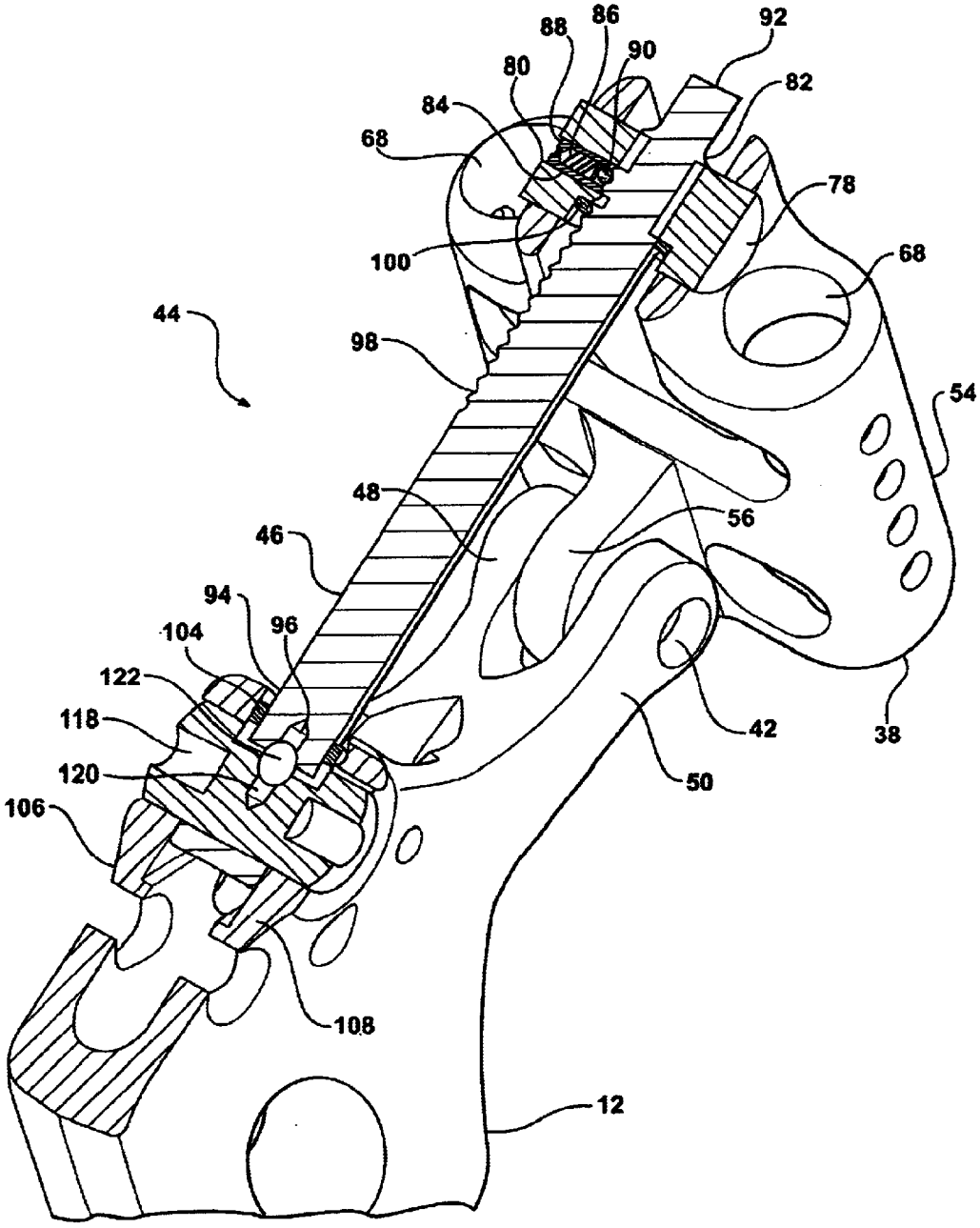
FIG. 5 is a cross-sectional view of the strut assembly between the limb and riser.

A ball plunger 84 is threaded into the bore 80 as shown in FIGS. 2 and 5. The ball plunger 84 includes a compression spring 86 seated between a cap 88 and ball bearing 90. The ball plunger 84 is biased against the power screw 46 for indexing the rotational position of the power screw 46 relative to the screw nut 78 as will be further described hereinbelow.

The strut power screw 46 is a cylindrical threaded rod extending longitudinally between a first nut end 92 and a second distal end 94 having a concave recess 96 therein. The power screw 46 further includes a row of spaced apart indexing holes or recesses 98 extending along the longitudinal extent of the screw 46 for engagement with the ball plunger 84. The power screw 46 may include one or more rows of indexing holes 98 around the perimeter of the screw 46 at any number of spaced apart degrees of separation with the individual holes 98 spaced apart longitudinally as desired. For example, the screw may include two parallel rows of indexing holes 98 spaced apart 180 degrees; three rows spaced apart 120 degree; four row spaced apart 90, etc.

Once the strut power screw 46 is threaded through the screw nut 78, the nut end 92 is seated between the support posts 70, 72. The second distal end 94 extends towards the end 18 of the riser 12 through a first strut shock absorber washer 100, a cylindrical resilient strut shock absorber 102 (which is corrogated as shown) and a second strut shock absorber washer 104.

Still referring to FIGS. 2 and 5, the riser 12 further includes spaced apart flanges 106, 108 each having a hole 110 therethrough with the axes of which are parallel to the axis of the pocket axle 42. A cylindrical strut power screw ball bearing retainer 112 is rotatably seated between the flanges 106, 108 and aligned axially with the holes 110. The retainer 112 includes an axial bore 114 aligned with the holes 110 and a transverse bore 116 extending perpendicular to and through the axial bore 114 for receiving the distal end 94 of the power screw 46.

Finally, the strut assembly 44 includes a cylindrical strut pivot support 118 dimensioned to be rotatably received in the axial bore 114 of the retainer 112 and holes 110 of the riser flanges 106, 108. The strut pivot support 118 includes a recessed detent 120 in the periphery outer wall thereof for seating and supporting a ball bearing 122. The second distal end 94 of the power screw 46 is inserted through the transverse bore 116 in the ball bearing retainer 112 and the ball bearing 122 is rotatably seated between the recess 96 in the end of the power screw 46 and the detent 120 in the pivot support 118 to facilitate rotation of the strut power screw 46.

The strut assembly 44 enables the end user of the archery bow 10 to assemble, disassembly and micro-tune or selectively adjust the characteristics of the bow 10 without the necessity of a conventional bow press typically used to compress the bow limbs and allow removal of the cables and string. More specifically, once the limbs 14, 16 are secured to the limb pockets 38, 40, the limb pockets 38, 40 may be pivotally attached to the opposing ends 18, 20 of the riser 12. The strut assembly 44 is then coupled between the limb pockets 38, 40 and each end 18, 20 of the riser 12. Next, the wheels or cams 30, 32 may be assembled to the distal ends of the limbs 14, 16 and then the harness or cable system 34 and string 36 are attached to the wheels or cams 30, 32. The strut assembly 44 allows the limbs 14, 16 to be pivoted toward the riser 12 to reduce the distance between the distal ends of the limbs 14, 16 for attachment of the harness 34 and string 36 without tension. Once assembled, the nut end 92 of the strut power screw 46 may be rotated using a ratchet or wrench in a clockwise direction as shown in the drawings to increase the angle between the limbs 14, 16 and riser 12 until the limbs 14, 16 start to flex naturally due to the fixed length of the string 36 and harness 34 coupled between the wheels 30, 32. Rotating the strut power screw 46 forces the power screw nut 78 to travel longitudinally along the threaded length of the screw 46 and pivot the limb pocket 38, 40 about the pocket axle 42 and riser 12. As the strut power screw 46 is rotated and the limbs 14, 16 flex and pivot open relative to the riser 12, the distance between the wheels or cams 30, 32 increases and the harness 34 and string 36 is pulled in tension to a desired draw weight. Additionally, the strut shock absorber 102 which encases and protects the strut power screw 46 may be compressed between the limb pockets 38, 40 and riser 12 to allow pivotal movement of the limbs 14, 16 while preventing dirt and debris from entering the strut assembly 44.

In order to disassembly the bow 10, the strut power screw 46 is simply rotated in the opposite, or counter-clockwise direction as shown, so that the screw nut 78 travels down the length of the screw 46 pivoting the limb pocket 38, 40 about the pocket axle 42 and riser 12 until the tension on the string 36 and harness 34 is loosened. The bow 10 may then be fully disassembled or part may be changed such as the string 36 without the need of a bow press to release the flex and tension on the limbs 14, 16 and string 36.

Finally, the strut assembly 44 also allows selective adjustment of the bow 10 by rotation of the strut power screw 46 in either the clockwise or counterclockwise direction. As the screw nut 78 travels along the length of the threaded power screw 46 forcing the limb pocket 38, 40 to pivot about the riser 12, the ball plunger 84 follows the outer perimeter of the power screw 46 and engages with each indexing holes 98 along the length of the power screw 46. By counting or tracking the position of the ball plunger 84 relative to the indexing holes 98, the bow 10 may be selectively adjusted by pivoting or tuning each limb 14, 16 position relative to the riser 12 to adjust the tension on the string 36 and the flex of the limbs 14, 16 which account for the draw weight of the bow 10 and also the axle to axle length defined between the wheels or cams 30, 32. The location of the ball plunger 84 along the indexing holes 98 is maintain absent additional rotation of the power screw 46. Therefore, by identifying the desired reference of the ball plunger 84 along the indexing holes 98, the user may re-establish this adjustment after assembly and disassembly or after further tuning without having to go back to the factory recommended settings. Additionally, the user may selective adjust the bow 10 for different shooting conditions. For example, the strut assembly 44 allows the user to adjust the axle to axle distance to 37 inches during target practice and then adjust the axle to axle distance to 34 inches for hunting. The strut assembly 44 also allows the user to selectively adjust the bow draw weight infinitely by rotating the power screw 46 and pivoting the limbs 14, 16 relative to the riser 12.

It should be appreciated to one skilled in the art that the strut assembly may be used on a recurve bow, compound bow or cross bow without varying from the invention. Additionally, the strut assembly may be coupled between only one of the limbs and the riser or both of the limbs and the riser. That is, one of the limbs may be fixedly attached to one end of the riser and the other limb pivotally attached to the opposite end of the riser with the strut assembly extending therebetween to selectively pivot the one limb relative to the riser sufficient to release the tension on the string and allow assembly, disassembly and tuning of the bow.

Finally, it should also be appreciated that the strut pivoting power screw nut 78 may be retained in the riser 12 and the strut pivot support 118 retained by the limb 14 or limb pocket 38 without varying from the scope of the invention or function of the strut assembly 44.

The invention has been described in an illustrative manner, and it is to be understood that the terminology, which has been used, is intended to be in the nature of words of description rather than of limitation.

Many modifications and variations of the present invention are possible in light of the above teachings. It is, therefore, to be understood that within the scope of the appended claims, the invention may be practised other than as specifically described.

What is claimed is:

1. An archery bow comprising:

a riser extending between opposing first and second ends;

a limb coupled to each end of said riser, each limb having a first end for connecting to the riser and a second distal end;

an axle pivotally connecting at least one of said limbs to one end of said riser; and a strut assembly operatively coupled between at least one of said limbs and said riser adjacent said axle for selectively pivoting said limb relative to said riser thereby allowing manual assembly and tuning of the bow by varying the distance between said distal ends of said limbs.

2. An archery bow as set forth in claim 1 wherein said strut assembly includes a strut power screw having a first end pivotally coupled to said limb and an opposite end pivotally coupled to said riser.

3. An archery bow as set forth in claim 2 wherein said strut assembly includes a screw nut retained by one of said limb and said riser and movably coupled to said strut power screw for movement along the length thereof to pivot said limb about said axle and riser.

4. An archery bow as set forth in claim 3 wherein said strut power screw has threads and said screw nut is threadedly attached to said strut power screw whereby rotation of said strut power screw forces said screw nut to travel along the longitudinal length of said strut power screw and pivot said limb about said riser.

5. An archery bow as set forth in claim 4 wherein said strut assembly includes a strut pivot support retained by said riser for rotatably supporting said strut power screw on said riser.

6. An archery bow as set forth in claim 5 wherein said strut power screw includes a first nut end and an opposite second distal end with said threads extending therebetween.

7. An archery bow as set forth in claim 6 wherein said strut pivot support includes a recessed detent for rotatably supporting said second distal end of said strut power screw.

8. An archery bow as set forth in claim 7 wherein said strut assembly includes a ball bearing seated between said second distal end of said strut power screw and said recessed detent of said strut pivot support to allow free rotation of said strut power screw between said limb and said riser.

9. An archery bow as set forth in claim 8 wherein said strut assembly includes a ball bearing retainer having an axially bore for rotatably housing said strut pivot support and a transverse bore for housing said ball bearing.

10. An archery bow as set forth in claim 9 wherein said riser includes a pair of spaces apart flanges having axially aligned holes for rotatably supporting said ball bearing retainer and strut pivot support.

11. An archery bow as set forth in claim 10 wherein said strut power screw includes a row of spaced apart indexing holes extending at least partially between said first and second ends.

12. An archery bow as set forth in claim 11 further including a ball plunger supported by said screw nut for cooperating with a select one of said indexing holes during rotation of said strut power screw for identifying the selected adjusted position of said limb relative to said riser.

13. An archery bow as set forth in claim 12 wherein said ball plunger includes a ball bearing for engaging said strut power screw and a spring compressed between said screw nut and said ball bearing for biasing said ball bearing against said strut power screw and indexing holes.

14. An archery bow as set forth in claim 13 further including a limb pocket having a base for fixedly supporting said first end of said limb and a pivot post for receiving said axle and pivotally attaching said limb to said riser.

15. An archery bow as set forth in claim 14 wherein said limb pocket includes a pair of spaced apart support posts extending from said base each having an axially aligned bore therethrough for rotatably supporting said screw nut between said posts.

16. An archery bow as set forth in claim 15 wherein said strut assembly includes a resilient shock absorber encasing said strut power screw between said limb and said riser.

* * * * *